US008905335B1

(12) United States Patent
Mulder

(10) Patent No.: US 8,905,335 B1
(45) Date of Patent: Dec. 9, 2014

(54) CASTING NOZZLE WITH DIMENSIONAL REPEATABILITY FOR VISCOUS LIQUID DISPENSING

(75) Inventor: Edwin J. Mulder, Laplata, MD (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 747 days.

(21) Appl. No.: 12/456,266

(22) Filed: Jun. 10, 2009

(51) Int. Cl.
*A62C 31/02* (2006.01)

(52) U.S. Cl.
USPC ..... 239/589; 239/565; 22/591

(58) Field of Classification Search
CPC ..... B05B 1/34; B05B 1/005
USPC ..... 239/589, DIG. 19; 222/591–606; 285/132.1, 131.1, 125.1; 29/890.142, 29/890.143, 527.3, 527.5
See application file for complete search history.

(56) References Cited

U.S. PATENT DOCUMENTS 3,914,178 A * 10/1975 Fineran et al. ..... 508/103
3,970,174 A * 7/1976 Kirkhart ..... 188/251 A
4,378,853 A * 4/1983 Chia et al. ..... 175/340
4,457,364 A * 7/1984 DiNicolantonio et al. 165/134.1
4,671,433 A * 6/1987 Podrini et al. ..... 222/606
5,059,266 A 10/1991 Yamane et al.
5,173,220 A 12/1992 Reiff et al.
5,402,993 A * 4/1995 Hofmann et al. ..... 266/236
5,944,261 A 8/1999 Heaslip et al.
6,016,651 A * 1/2000 Hammond et al. ..... 60/39.5
6,152,336 A * 11/2000 Arvedi et al. ..... 222/594
6,364,986 B1 * 4/2002 Kieronski ..... 156/242
6,533,146 B1 3/2003 Ando et al.
6,998,089 B2 2/2006 Osaki
7,140,521 B2 11/2006 Kapaj et al.
2007/0095500 A1 * 5/2007 Numano et al. ..... 164/437

FOREIGN PATENT DOCUMENTS

WO WO2008/124498 * 10/2008 ..... B05B 13/02

* cited by examiner

*Primary Examiner* — Len Tran
*Assistant Examiner* — Joel Zhou
(74) *Attorney, Agent, or Firm* — Fredric J. Zimmerman

(57) ABSTRACT

A casting nozzle includes a monolithic nozzle body made from a cured photopolymer. A conductive metal coats the exterior surfaces of the nozzle body to a thickness in the range of about 2-about 4 ten-thousandths of an inch.

17 Claims, 1 Drawing Sheet

CASTING NOZZLE WITH DIMENSIONAL REPEATABILITY FOR VISCOUS LIQUID DISPENSING

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to nozzle construction, and more particularly to a casting nozzle whose dimensions can be accurately reproduced on a repetitive basis so that liquids, and in particular, viscous liquids such as rocket motor cast composite propellants can be dispensed with minimal variability from nozzle to nozzle.

BACKGROUND OF THE INVENTION

Volumetric loaders are used in variety of commercial and military applications. In general, a volumetric loader includes a large supply of a material (e.g., liquid, viscous liquid, granules, cast composite propellants, etc.) that is to be dispensed/distributed in small quantities to a number of relatively small receptacles. The material could be harmless (e.g., candy) or hazardous (e.g., ignitable propellants, explosives, etc.). For simplicity and cost effectiveness, many volumetric loaders utilize the force of gravity to supply the material to one or more dispensing or casting orifice arrangements, nozzles, etc. While this eliminates the need for costly and maintenance-requiring pumps, it also means that the casting nozzles should minimally obstruct the flow of any material supplied thereto. Further, in cases where precise amounts of the material must be dispensed, the casting nozzles must be producible with a minimum of variation during the production thereof so that dispensing performance and accuracy remains essentially constant from nozzle-to-nozzle.

SUMMARY OF THE INVENTION

Accordingly, it is an object of the present invention to provide a casting nozzle.

Another object of the present invention is to provide a casting nozzle that may be produced with a minimum of variability.

Still another object of the present invention is to provide a casting nozzle that may be used to safely dispense ignitable materials.

Other objects and advantages of the present invention will become more obvious hereinafter in the specification and drawings.

In accordance with the present invention, a casting nozzle is provided for dispensing liquids, for example, viscous liquids, in a casting operation. A monolithic nozzle body is made from a cured photopolymer. In an exemplary embodiment, the monolithic nozzle body is a Y-shaped monolithic nozzle body. The nozzle body has interior surfaces and exterior surfaces with the interior surfaces adapted to receive a liquid and pass the liquid therethrough. A conductive metal coats the exterior surfaces to a thickness in the range of about 2 ten-thousands-about 4 ten-thousandths of an inch.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
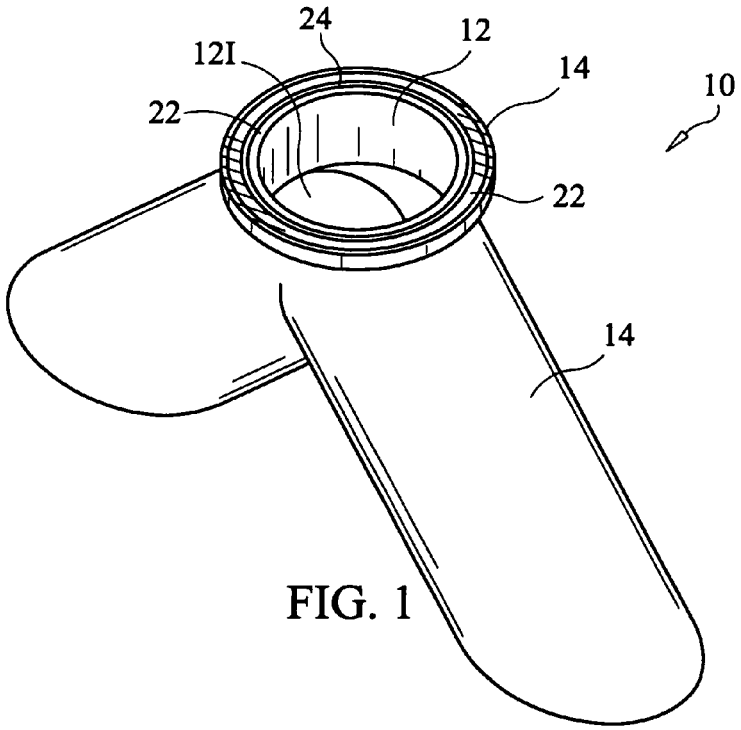
FIG. 1 is a perspective view of a Y-shaped casting nozzle in accordance with an embodiment of the present invention.
Figure 2:
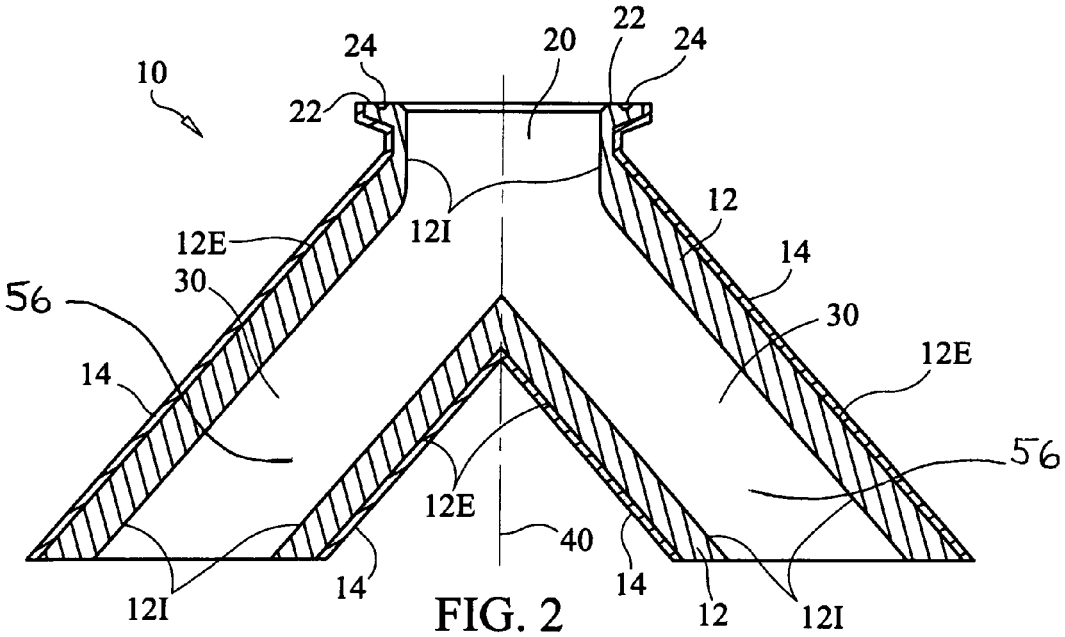
FIG. 2 is a cross-sectional view of the Y-shaped casting nozzle.

Referring now to the drawings, simultaneous reference will be made to FIGS. 1 and 2 where a Y-shaped casting nozzle in accordance with embodiment of the present invention is shown and is referenced generally by numeral 10. By way of example, nozzle 10 will be described for its use with a loader (not shown) that releases a liquid and, for example, a viscous liquid therefrom under the force of gravity where the viscous liquid is one that will readily burn or explode upon ignition. For example, the viscous liquid could be a viscous rocket propellant that is to be cast into rocket motor casings (not shown). However, it is to be understood that nozzle 10 may be other than Y-shaped and/or used to dispense other viscous liquids, granules, cast composite propellants, etc., without departing from the scope of the present invention.

In general, nozzle 10 includes a monolithic nozzle body 12 with the exterior surfaces 12E thereof being coated with a conductive metal 14. Nozzle body 12 is made from a cured photopolymer material so that the interior surfaces 12I of nozzle body 12 are smooth and glassy. This material type insures a smooth flow of a viscous liquid as it moves through nozzle body 12 under the force of gravity. In order to provide a nozzle body 12 that may be readily produced in a way that maintains dimensional tolerances from nozzle-to-nozzle, the cured photopolymer material may be generated using stereolithography processes and equipment.

Such processes/equipment are well known in the art. The choice of a particular photopolymer should include the criteria that it be chemically inert or resistant with respect to the viscous liquid or other material that is to flow through nozzle body 12.

In the illustrated, exemplary embodiment, nozzle body 12 includes a single inlet region 20 and two identically-sized dispensing channels 30 coupled to inlet region 20 so as to be of a uni-body construction and, in particular, a one-piece casting. Inlet region 20 includes an annular end face 22 that can have a continuous channel 24 formed therein. Channel 24 serves as a receptacle for an O-ring (not shown) that will be used to ensure a seal between nozzle body 12 and a loader (not shown) to which it is coupled. Further, the inlet region 20 is a single-cylinder shaped inlet region 20 continuously extending from the annular end face 22 to the dispensing channels 30. Each of the dispensing channels 30 is a straight tubular part of nozzle body 12 with a specific diameter 56. Each of dispensing channels 30 is formed such that interior surface 12I of nozzle body 20 is contiguous between inlet region 20 and each of dispensing channels 30. Dispensing channels 30 are mirror images of one another relative to a centerline (referenced by dashed line 40) of nozzle body 12 so that the dispensing channels 30 are symmetric about the centerline 40. In this way, each dispensing channel 30 will receive an equivalent portion of the viscous liquid entering inlet region 20. Further, the annular end face 22 of the inlet region 20 includes, in an exemplary embodiment, a diameter of about 1.75 inches. The diameter 56 of each of the dispensing channels 30 may range from about 0.75 inches to about 1.25 inches depending on the desired flow rate where the larger diameter produces an increased flow rate compared to the smaller diameter, that is, about 0.75 inches. In particular, the diameter 56 may be about 1.25 inches to produce the highest flow rate, and thus the minimum (smallest) time in a casting cycle As mentioned above, nozzle 10 includes conductive metal 14 coating the exterior surfaces 12E of nozzle body 12. By coating nozzle body 12 in this way, any unwanted electrostatic charges are prevented from reaching the interior regions of nozzle body 12. Penetration of nozzle body 12 by electrostatic changes could be hazardous in cases where the material passed through nozzle body 12 could ignite and explode or burn. Metal 14 may generally have a thickness that is in the range of about 2 to about 4 ten-thousandths of an inch in order to prevent the conductive metal coating 14 from peeling from the photopolymer nozzle body. The material used for the conductive metal 14 may include copper, nickel, or other suitable electrical conductors that can be applied to all exterior surfaces 12E of nozzle body 12. For example, interior surfaces 12I could be masked and an electrolysis nickel can be applied to exterior surfaces 12E. Another option is to mask interior surfaces 12I and copper could be sputter coated onto exterior surfaces 12E. Based on the exemplary embodiment, the inventive configuration requires less force needed to push the material, such as, the liquid, through the nozzle 10 particularly as the material is not impeded by restrictions at an interface of the dispensing channels 30 with the inlet region 20.

The advantages of the present invention are numerous. A nozzle body 12 made from a cured photopolymer provides a smooth interior nozzle surface 12I that offers minimal resistance to a viscous liquid flowing therethrough. Further, the photopolymer material allows the nozzle body 12 to be constructed using stereolithography equipment and processes. This type of material allows the nozzle body 12 to be rapidly produced and insures minimal dimensional variability from nozzle-to-nozzle owing to the precision of stereolithographic processes. By coating the exterior surfaces of the nozzle body with a conductive metal, the resulting casting is a safe option for use in the casting of explosives or propellants.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set, forth in the specification and attached claims are approximations (for example, by using the term "about") that may vary depending upon the desired propertied sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A casting nozzle for dispensing liquids in a casting operation, comprising:

a monolithic nozzle body being comprised of a cured photopolymer, wherein said monolithic nozzle body includes interior surfaces and exterior surfaces, and wherein said interior surfaces adapted to receive a liquid and pass the liquid therethrough; and a conductive metal coating said exterior surfaces for providing a thickness in a range of about 2 ten thousandths-about 4 ten-thousandths of an inch, wherein the monolithic nozzle body includes a plurality of dispensing channels and an inlet region coupled to the plurality of dispensing channels where the inlet region includes a first diameter and each of the plurality of dispensing channels includes a second diameter, respectively, wherein the first diameter is greater than each said second diameter, wherein the plurality of dispensing channels are symmetric about a centerline to form an inverted V-shaped bottom portion of the monolithic nozzle body, wherein the plurality of dispensing channels contact each other at a flow-dividing point at the centerline, wherein each of the plurality of dispensing channels comprises a bottom outlet portion, where each said bottom outlet portion is in a same horizontal plane as another said bottom outlet portion, wherein said each of the plurality of dispensing channels comprises a length portion situated between the bottom outlet portion and the flow-dividing point where said length portion is a straight shaped length portion, and wherein said second diameter includes a constant cross sectional area throughout a length of said each of the plurality of dispensing channels.

2. The casting nozzle as in claim 1, wherein said cured photopolymer is selected to be chemically resistant to the liquid to be passed therethrough, and wherein said liquid is a viscous liquid.

3. The casting nozzle as in claim 1, wherein said cured photopolymer comprises a stereolithography-cured photopolymer.

4. The casting nozzle as in claim 1, wherein said conductive metal is selected from the group consisting of copper and nickel.

5. The casting nozzle as in claim 1, wherein said conductive metal comprises electrolysis nickel.

6. The casting nozzle as in claim 1, wherein said conductive metal comprises sputtered copper.

7. The casting nozzle as in claim 1, wherein said monolithic nozzle body defines a single inlet adapted to receive, initially, receive the liquid, and wherein said monolithic nozzle body further defines a plurality of identically-sized outlet channels coupled to said single inlet with each of said outlet channels adapted to discharge an equivalent portion of the liquid so-received in said single inlet.

8. A casting nozzle for dispensing a liquid in a casting operation, comprising:

a Y-shaped nozzle body being made from a stereolithography-cured photopolymer, wherein said Y-shaped nozzle body comprises interior surfaces and exterior surfaces, and wherein said Y-shaped nozzle comprises a single inlet adapted to initially receive a viscous liquid, and two straight and identically-sized outlet channels coupled to said single inlet with each of said outlet channels adapted to discharge an equivalent portion of the liquid so-received in said single inlet; and a conductive metal coating said exterior surfaces for providing a thickness in the range of about 2 ten-thousandths-about 4 ten-thousandths of an inch, wherein the single inlet includes a first diameter and each of the two-straight and identically-sized outlet channels includes a second diameter, respectively, wherein the first diameter is greater than each said second diameter, wherein the two straight and identically-sized outlet channels are symmetric about a centerline to form an inverted V-shaped bottom portion of the Y-shaped nozzle body, wherein the two straight and identically-sized outlet channels contact each other at a flow-dividing point at the centerline, wherein each of the two straight and identically-sized outlet channels comprises a bottom outlet portion, where each said bottom outlet portion is in a same horizontal plane as another said bottom outlet portion, wherein said each of the two straight and identically-sized outlet channels comprises a length portion situated between the bottom outlet portion and the flow-dividing point where said length portion is a straight shaped length portion, wherein said second diameter includes a constant cross sectional area throughout a length of said each of the two straight and identically-sized outlet channels, and wherein the Y-shaped nozzle body is a monolithic shaped nozzle body including the two straight and identically-sized outlet channels.

9. The casting nozzle as in claim 8, wherein said stereolithography-cured photopolymer is selected to be chemically resistant to the liquid to be passed therethrough.

10. The casting nozzle as in claim 8, wherein said conductive metal is selected from the group consisting of copper and nickel.

11. The casting nozzle as in claim 8, wherein said conductive metal comprises electrolysis nickel.

12. The casting nozzle as in claim 8, wherein said conductive metal comprises sputtered copper.

13. A casting nozzle for dispensing multiple and equal quantities of a liquid supplied thereto by a gravity-fed loader, comprising:

a monolithic nozzle body being comprised of a stereolithography-cured photopolymer, wherein said monolithic nozzle body comprises interior surfaces and exterior surfaces, and wherein said monolithic nozzle body comprises a single inlet, which includes an annular end face with an o-ring receptacle formed therein, and two straight and identically-sized outlet channels coupled to said single inlet; and a conductive metal coating said exterior surfaces to a thickness in a range of about 2 ten-thousandths-4 ten-thousandths of an inch, wherein the monolithic nozzle body is a Y-shaped nozzle body, wherein the single inlet includes a first diameter and each of the two straight and identically-sized outlet channels includes a second diameter, respectively, wherein the first diameter is greater than each said second diameter, wherein the two straight and identically-sized outlet channels are symmetric about a centerline to form an inverted V-shaped bottom portion of the monolithic nozzle body, wherein the two straight and identically-sized outlet channels contact each other at a flow-dividing point at the centerline, wherein each of the plurality of two straight and identically-size outlet channels comprises a bottom outlet portion, where each said bottom outlet portion is in a same horizontal plane as another said bottom outlet portion, wherein each of the plurality of two straight and identically-sized outlet channels comprises a length portion situated between the bottom outlet portion and the flow-dividing point where said length portion is a straight shaped length portion, and wherein said second diameter includes a constant cross sectional area throughout a length of said each of the plurality of dispensing channels.

14. The casting nozzle as in claim 13, wherein said stereolithography-cured photopolymer is selected to be chemically resistant to the liquid; and wherein said liquid is a viscous, ignitable liquid.

15. The casting nozzle as in claim 13, wherein said conductive metal is selected from the group consisting of copper and nickel.

16. The casting nozzle as in claim 13, wherein said conductive metal comprises electrolysis nickel.

17. The casting nozzle as in claim 13, wherein said conductive metal comprises sputtered copper.

* * * * *